United States Patent [19]

Schreiber et al.

[11] Patent Number: 4,723,289

[45] Date of Patent: Feb. 2, 1988

[54] STEREO ELECTROACOUSTIC TRANSDUCING

[75] Inventors: William P. Schreiber, Ashland; Christopher B. Ickler, Brighton, both of Mass.

[73] Assignee: Bose Corporation, Framingham, Mass.

[21] Appl. No.: 840,021

[22] Filed: Mar. 17, 1986

[51] Int. Cl.[4] ..... H04R 5/00

[52] U.S. Cl. ..... 381/24; 381/99

[58] Field of Search ..... 381/24, 88, 89, 90, 381/100, 99, 103

[56] References Cited

U.S. PATENT DOCUMENTS 3,104,729 9/1963 Olson ..... 381/24
4,006,311 2/1977 Carlsson ..... 381/24
4,503,553 3/1985 Davis ..... 381/59
4,578,809 3/1986 Eberbach ..... 381/24

*Primary Examiner*—Forester W. Isen
*Attorney, Agent, or Firm*—Charles Hieken

[57] ABSTRACT

A stereo loudspeaker system includes left and right loudspeaker cabinets each having a woofer mounted off center on the front baffle and tweeters mounted in front of the woofer with the axis of each tweeter at an angle to that of the woofer. Each cabinet includes a crossover network that intercouples the woofer and tweeter and controls the phasing of the tweeter with respect to the woofer to steer the radiation maximum of lower treble frequencies along an axis skewed from the fore-aft axis of the woofer. Left and right loudspeakers of the stereo system have symmetrical, mirror-image, crossfired, acoustic radiation patterns.

10 Claims, 15 Drawing Figures

20
200
600
2000
6000
20,000
FREQ. Hz.
BOSE 10.2
BOSE 8.2
BOSE 6.2
BOSE 4.2
A
B
C
D
E
F
H

STEREO ELECTROACOUSTIC TRANSDUCING

The present invention relates in general to electroacoustical transducing and more particularly concerns novel apparatus and techniques for using left and right direct-radiating loudspeakers in a stereo system to provide good stereo imaging over a wide range of listening positions in the room through the transducing structure itself without complex electronics.

Conventional direct-radiating loudspeakers are typically designed to achieve flat frequency response and omnidirectionality. Each loudspeaker is inherently monaural, and a pair of such monaural loudspeakers typically form a stereo pair. These conventional monaural loudspeakers are typically spaced 5–12 feet apart. The resultant stereo imaging; that is, the apparent horizontal location of sound sources being reproduced, is consistent only in a narrow listening region where the listener's distance from both loudspeakers is equal. Outside of this narrow region midway between the two loudspeakers, precedence and intensity differences lead to localization at the nearer speaker with corresponding loss of information from the further speaker, which becomes essentially inaudible.

One approach to overcoming this problem described in U.S. Pat. No. 4,503,553 involves the design of complex electrical transducer networks that try to cause the energy received at each point in the listening area from each speaker to be so balanced that the listener perceives proper stereo imaging at every listening point in the room. This approach results in apparatus that is difficult and costly to design and manufacture.

Accordingly, it is an important object of this invention to provide a direct-radiating stereo loudspeaker system that provides good stereo imaging over a wide range of listening positions with structure that is relatively easy and inexpensive to manufacture.

According to the invention, first and second loudspeaker systems include means for skewing the radiation polar pattern of each in a direction toward the other to produce good stereo imaging from the pair for a wide listening area.

Numerous other features, objects and advantages of the invention will become apparent from the following specification when read in connection with the accompanying drawing in which.

Figure 1:
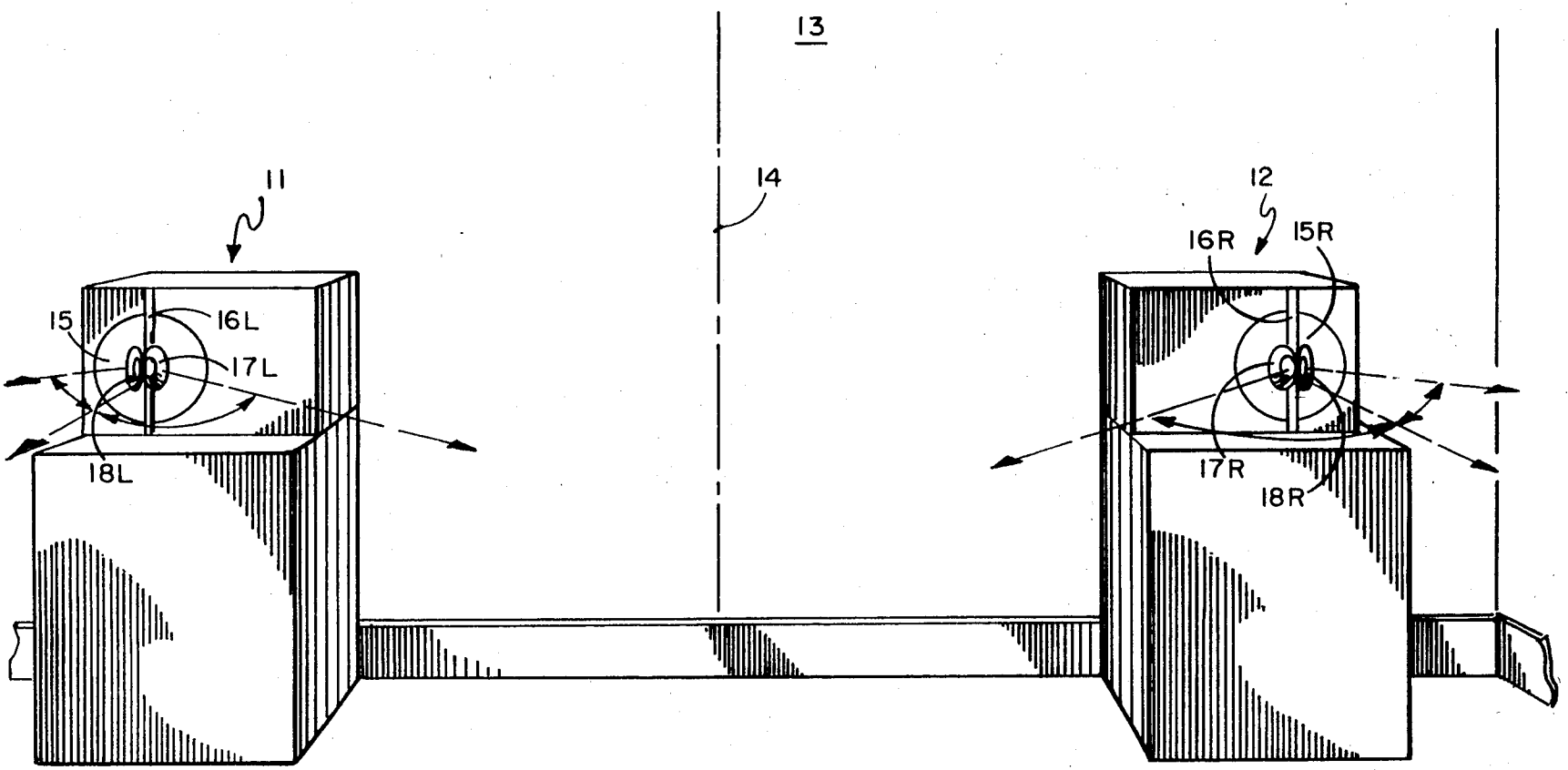
FIG. 1 is a perspective view of a pair of loudspeaker systems each having a woofer and two tweeters according to the invention.

It has been determined through psychoacoustic experiments that each loudspeaker in a stereo pair should have a radiation polar pattern skewed toward its partner to achieve consistent imaging of first arrival transients over a wide listening area; typically the sound pressure level at the off-axis maxima at 40°–50° from the fore-aft axis should be 5–10 dB above that on the fore-aft axis. This difference is greater than the difference expected for intensity differences because of the precedence effect of first arrival transients in the nearer speaker. Since real music is a combination of transients and quasi-steady-state tones, and stereo recordings have widely variable amounts of channel separation, it has been discovered through empirical/listening tests that a difference of 3–6 dB will adequately simulate a perceived distribution of sound sources that corresponds to that in the original program material captured on the stereo recording. The left and right loudspeakers in such a stereo system should thus have symmetric, mirror-image, crossfired radiation patterns.

These results are achieved by a variety of techniques in the current invention. Low-frequency components of program material (typically 20 Hz–200 Hz) are not important for localizing and are not covered by the current invention. Middle-frequency components of program material (typically 200 Hz–1.5 kHz) are skewed by using two low-frequency transducers (woofers) whose axes are in the same horizontal plane and the bisector of the angle formed by those axes is substantially 40°–50° from the fore-aft axis of the loudspeaker, by placing the woofer off center in the baffle which causes the greater acoustic radiation toward that side with the greater expancs of baffle, and by simply angling the woofer in the desired direction. High-frequency components of program material (typically 1.5 kHz–20 kHz) are directed by proper location and phasing of the high frequency transducer(s) (tweeters) with respect to the woofer, by proper location and phasing with respect to one another in two-tweeter systems, and by simply aiming the tweeters along the desired axis to steer the highest treble frequencies. Left and right speakers are designed as mirror images to achieve the desired mirror-image cross-fired radiation pattern while maintaining a balanced power response independent of passband frequency.

In some embodiments of these principles, an open back dipole tweeter is used as shown below in FIG. 2 to produce a desired null perpendicular to the tweeter axis. In other embodiments two tweeters are connected out-of-phase with each other to steer the mid-treble frequencies away from the fore-aft axis. The woofer/-tweeter arrays are arranged approximately in the same horizontal plane to (1) empirically steer the beams at lower treble frequencies and (2) minimize vertical plane variations in the dispersion pattern, which minimization results in consistent first arrival frequency responses independent of (standing or sitting) listeners position.

The invention allows the listeners to hear both loudspeakers of a stereo pair over a very wide listening area. Via pyschoacoustic experiments, the time and intensity relationships, which determine localization, were determined for stereo loudspeakers. The invention realizes these relationships effectively at relatively low cost.

With reference now to the drawing and more particularly FIG. 1 thereof, there is shown a perspective view of a stereo loudspeaker system according to the invention. Left loudspeaker 11 and right loudspeaker 12 are located along wall 13 of a listening room to the left and right, respectively, of the listening room center line 14. Left and right loudspeaker systems 11 and 12 include left woofer 15L and right woofer 15R, respectively.

Vertical tweeter support members 16L and 16R mounted along the vertical diametrical planes of woofers 15L and 15R, respectively, support left and right tweeters 17L and 17R. respectively, oriented facing toward center line 14 in a direction toward each other. Tweeters 18L and 18R, respectively, are oriented facing away from centerline 14. Typically, the angle of the axis of each tweeter relative to the axis of the adjacent woofer is substantially 40°-50° to provide a radiation maximum that is along an axis substantially 40°-50° from the fore-aft axis of the loudspeaker systems.

Figure 2:
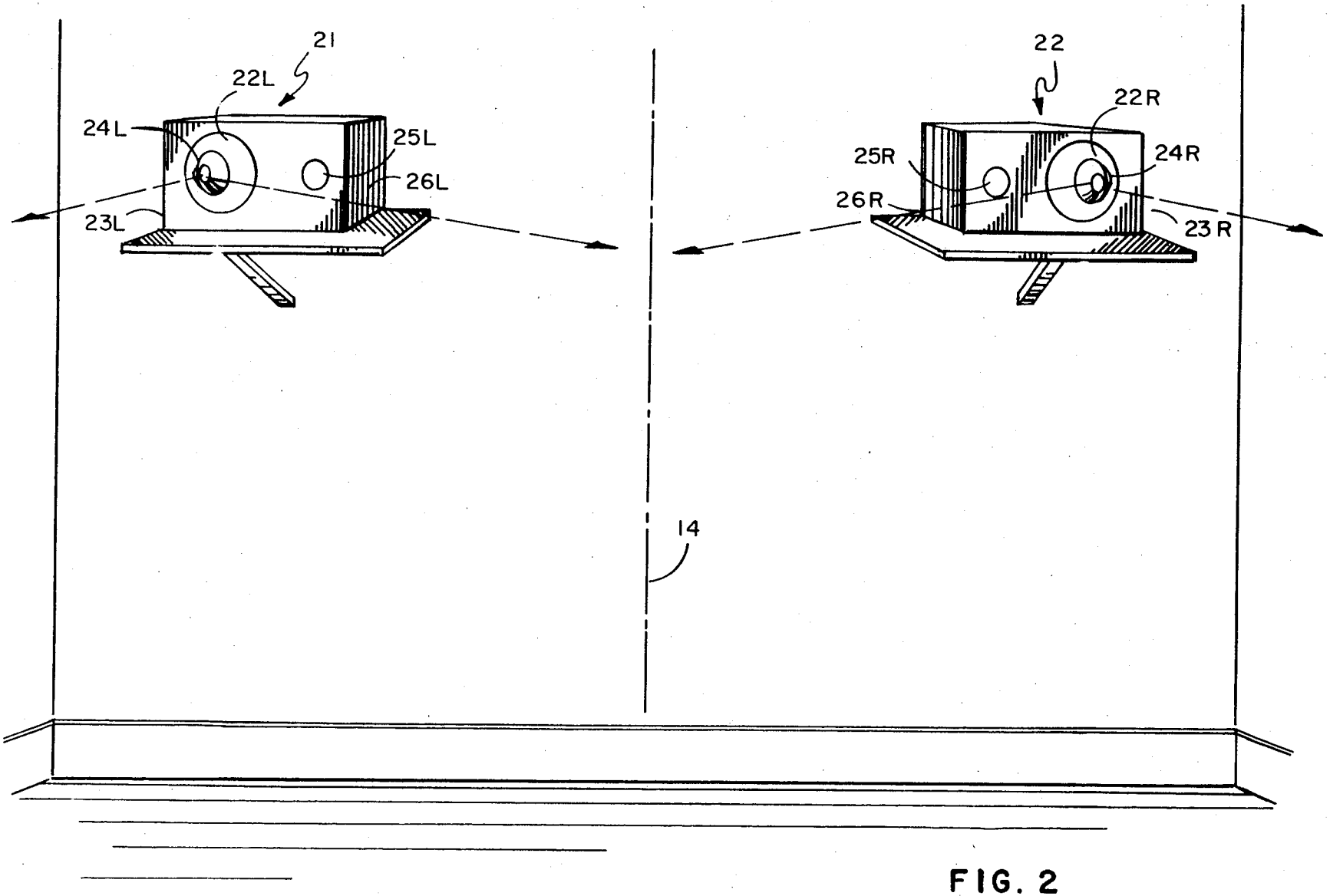
FIG. 2 is a perspective view of a pair of loudspeakers each having a woofer and open-backed tweeter according to the invention.

Referring to FIG. 2, there is shown another embodiment of the invention having left and right loudspeakers 21 and 22, respectively. Left loudspeaker 21 has a woofer 22L adjacent to left side panel 23L. Similarly right loudspeaker 22 has a woofer 22R adjacent to right side panel 23R. Left loudspeaker 21 has a tweeter 24L positioned to cover the left half of woofer 22L and angled so that its axis intersects the center line between loudspeakers 21 and 22. Right loudspeaker 22 has a right tweeter 24R covering the right half of woofer 22R and having its axis intersecting the center line between loudspeaker 21 and 22. Thus, tweeters 24L and 23R both point toward the room center line, typically at about an angle of about 40°-50°. Left loudspeaker 21 has a port 25L adjacent to right side 26L of loudspeaker 21. Right loudspeaker 22 has a port 25R adjacent to left side 26R. Thus, loudspeakers 21 and 22 are mirror images of each other.

Figure 3:
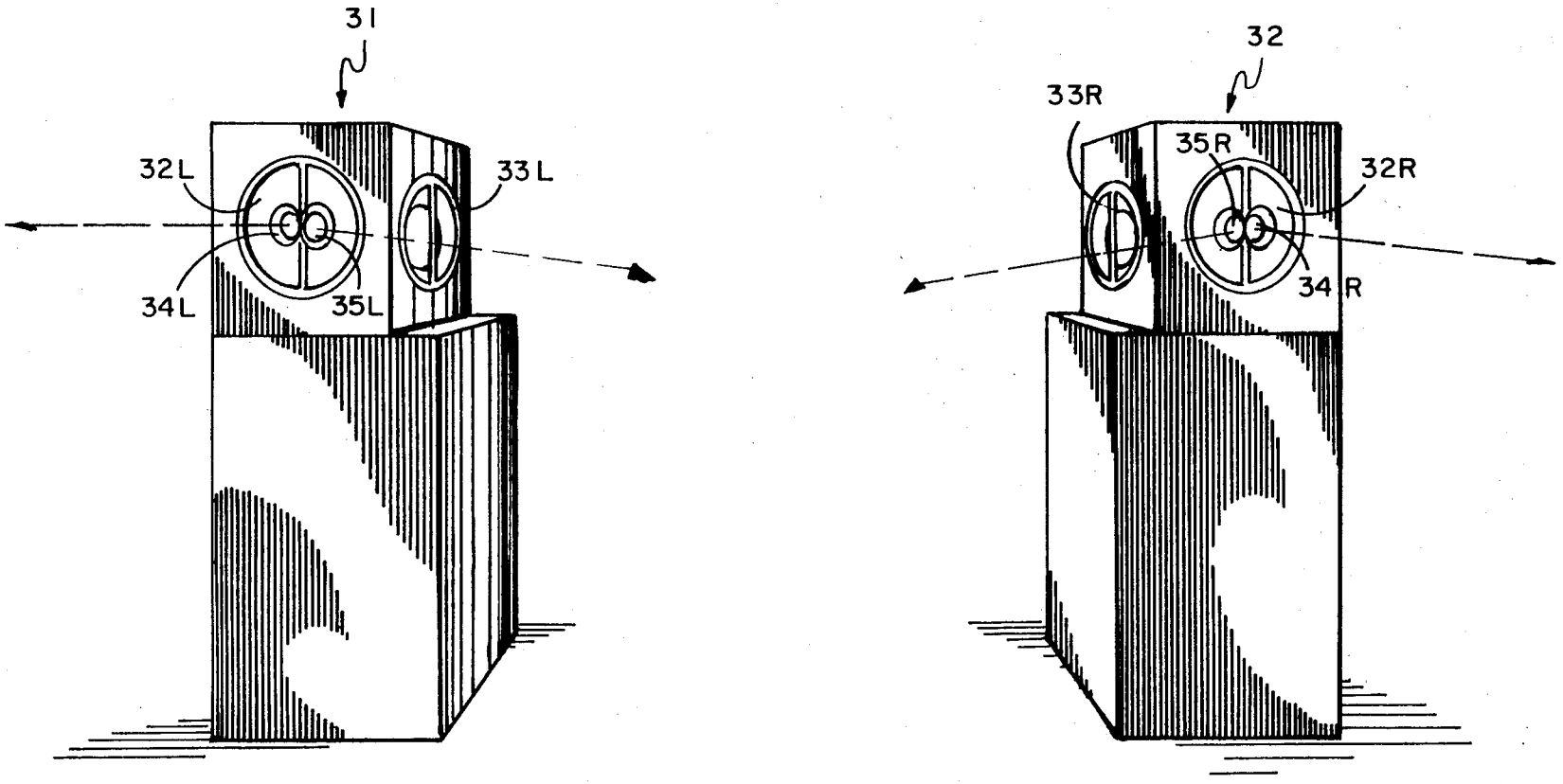
FIG. 3 is a perspective view of a pair of loudspeakers each having a pair of woofers and pair of tweeters according to the invention.

Referring to FIG. 3, there is shown a perspective view of another embodiment of the invention comprising left loudspeaker 31 and right loudspeaker 32. Left loudspeaker 31 has a pair of woofers 32L and 33L in space quadrature, left woofer 32L facing forward and left woofer 33L facing to the right. Similarly right loudspeaker 32 has two woofers 32R and 33R, woofer 32R facing forward and woofer 33R facing to the left.

Left loudspeaker 31 has a pair of angled tweeters 34L and 35L forward of woofer 32L. Similarly right loudspeaker 32 has a pair of tweeters 34R and 35R forward of woofer 32R. Woofers 32L and 33L are energized in phase as are woofers 32R and 33R. Tweeters 34L and 35L are energized in phase opposition as are tweeters 34R and 35R.

Figure 4:
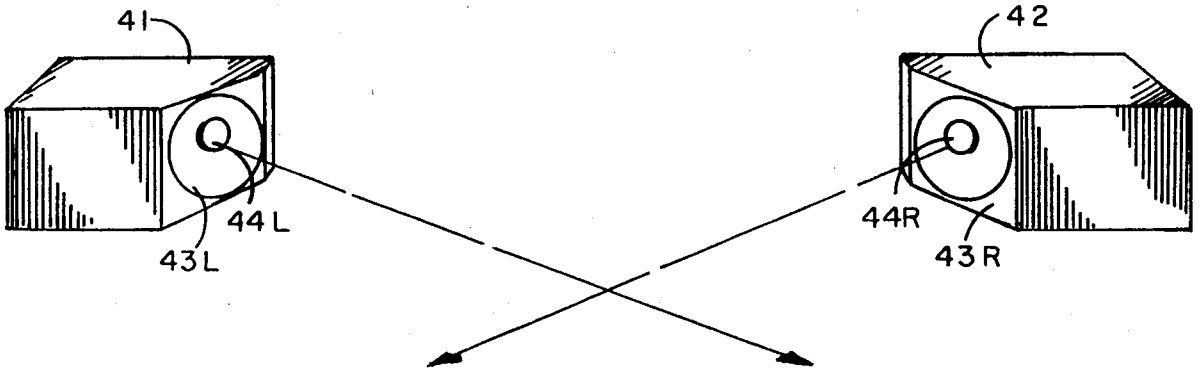
FIG. 4 is a perspective view of a pair of loudspeakers each having a woofer and tweeter according to the invention.
Figures 5, 5A, 5B, 5C, 5D, 5E, 5F, 5G, 5H, 5J:
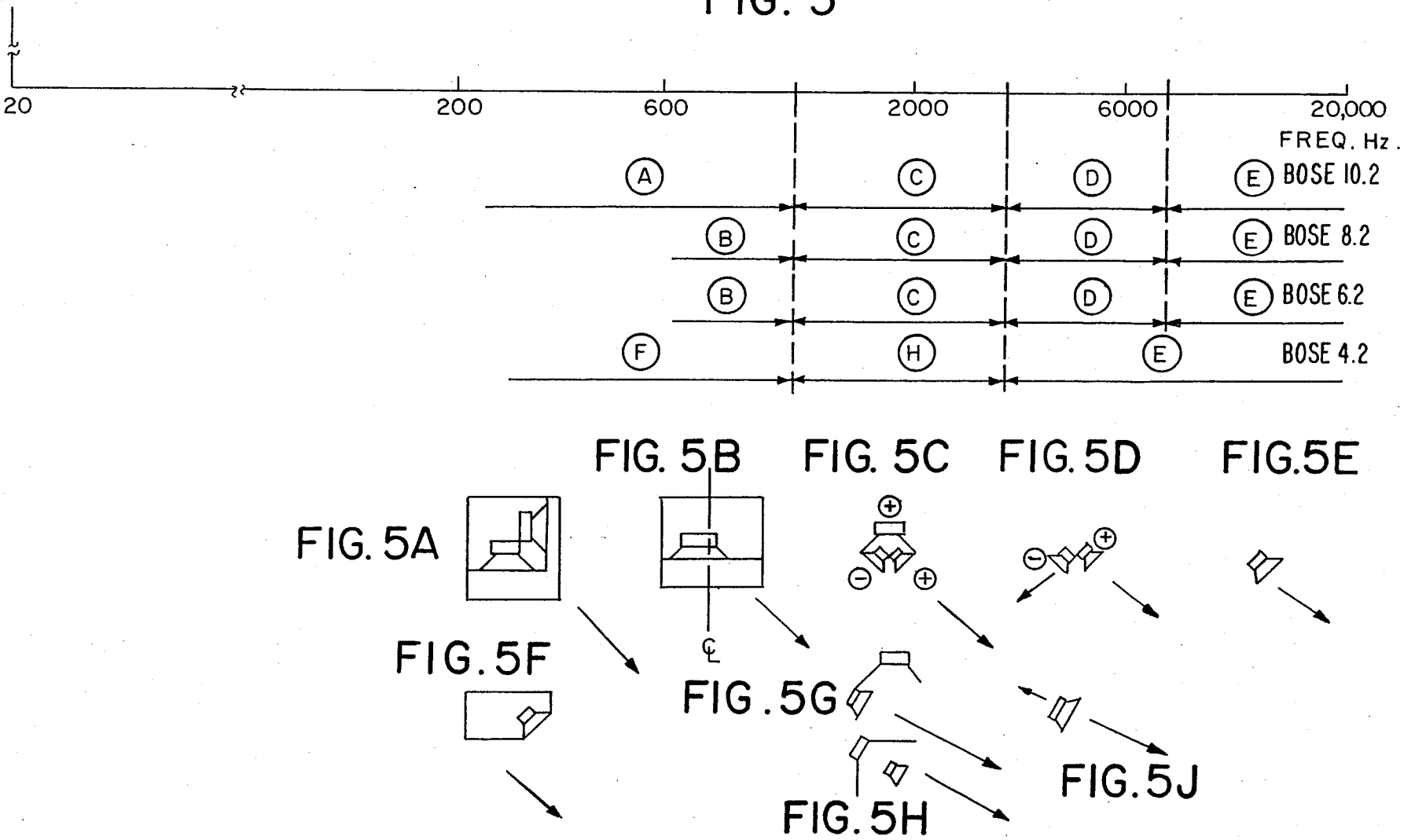
FIG. 5 is a graphical representation of the audio frequency spectrum and FIGS. 5A, 5B, 5C, 5D, 5E, 5F, 5G, 5H and 5J are pictorial representations of various woofer and tweeter structures.

Referring to FIG. 4, there is shown another embodiment of the invention comprising left loudspeaker 41 and right loudspeaker 42, each with a single woofer 43L and 43R, respectively, and tweeter 44L and 44R, respectively, all angled at about 40°-50° from the fore-aft axis of the respective speaker. Because it is more directional over a wider frequency bandwidth, the tweeter is angled somewhat less than the woofer in order to achieve lobing consistent with frequency. The tweeter is also slightly off the middle plane of the cabinet to prevent the frequency response aberrations otherwise caused by the symmetrical placement of the tweeter with respect to cabinet boundaries. In all embodiments of the invention, a suitable crossover network delivers energy having spectral components substantially above the crossover region to the tweeter(s) and substantially below the crossover region to the woofer(s) in accordance with the spatial distribution of spectral components discussed below. For those spectral components in the crossover region, i.e. those frequencies where the woofer(s) and tweeter(s) are radiating comparable energies, crossover elements are chosen which direct those spectral components along the desired crossfired radiation pattern.

The invention achieves the desired radiation pattern through combinations of several techniques:

1. For those frequencies whose wavelengths are comparable to or smaller than the diameter of the transducer, a transducer produces the greatest acoustic energy along its central axis. Thus, angling the transducer so that its axis in the horizontal plane points toward the desired direction will achieve the desired radiation pattern. This angling is used both for the high tweeter frequencies (5 kHz and up) and in woofers (200 Hz to 1.5 kHz) as described hereafter. This pattern may also be achieved by placing two identical transducers adjacent to one another wired in phase as shown in FIG. 3. These two in combination will have a directed radiation pattern similar to a single, larger transducer in the same location, with the greatest acoustic energy along the axis of symmetry of the two; e.g., if the two identical transducers were placed on adjacent baffles at 90° to one another, the greatest acoustic energy would be radiated along that axis forming a 45° angle with each baffle, as shown in FIG. 3.

2. For those frequencies whose wavelengths are comparable to or smaller than the transducer baffle dimensions, placement of a transducer to one side of its baffle directs greater acoustic energy toward the opposite side.

3. For those frequencies in the crossover region of a 2- or 3-way system, the acoustic radiation has a complex, lobed pattern in the plane containing the axes of the transducers. If the woofer(s) and tweeter(s) of a 2-way system are displaced in a vertical plane, as in conventional speakers, this lobed pattern is undesirable, causing spectral variations dependent on the listeners vertical position (standing or sitting). Locating both woofer and tweeter in the same horizontal plane can produce similar lobing in that horizontal plane. Spacing of the woofer and tweeter at greater than a wavelength distance will produce multiple lobes, while close spacing will produce a single-lobe pattern. The latter is used in this invention. Through proper placement of the woofer(s) and tweeter(s) in the horizontal plane, through proper selection of crossover elements and through proper tweeter phasing, the desired radiation pattern is achieved. With the woofer/dual tweeter on-axis system such as shown in FIG. 1, the beam lobe steers toward that tweeter which is in phase with the woofer and away from the out-of-phase tweeter.

4. For treble frequencies (i.e., frequencies produced by the tweeter(s)) whose wavelength is comparable to tweeter spacing in a 2-tweeter system, the radiation pattern may be controlled by wiring the tweeters out of phase with one another. For close-spaced tweeters, this produces a "Figure 8" radiation pattern. In this invention, one of the "Figure 8" lobes is directed along the desired axis.

Referring to FIGS. 5, 5A, 5B, 5C, 5D, 5E, 5F, 5G, 5H and 5J, there is shown a pictorial representation of various woofer and tweeter structures below a graphical representation of the audio frequency spectrum helpful in understanding how the principles described above are embodied in specific structures. The commercially available BOSE 4.2, 6.2, 8.2 and 10.2 stereo loudspeaker systems embody various combinations of woofer and tweeter structures, and these structures are associated with encircled letters A–J corresponding to a particular frequency range as indicated in which that structure radiates. Each of these encircled letters is associated with a diagrammatic representation of the structure for providing the lobe along the direction indicated by the associated arrow substantially over the frequency range indicated by the corresponding lettered region of the frequency scale at the top. Set forth in tabular form this information may be described as follows:

| | Structure | Frequency Range | Model |
|---|---|---|---|
| (A) | Two woofers in space quadrature | 250–1000 Hz | 10.2 |
| (B) | Asymmetrically Baffled Single Woofer | 600–1000 Hz | 6.2<br>8.2 |
| (F) | Single Woofer Pointing Inward | 250–1000 Hz | 4.2 |
| (C) | The Tweeter Pair on Front Woofer; Inside Tweeter in Phase Agreement with Woofer with Outside Tweeter in Phase Opposition to Woofer | 1000–3000 Hz | 6.2,<br>8.2,<br>10.2 |
| (G), (H) | Single Tweeter Asymmetrically in Front of Woofer | 1000–3000 Hz | 4.2 |
| (D) | Tweeters in Phase Opposition | 3000–7000 Hz | 6.2,<br>8.2,<br>10.2 |
| (J) | Asymmetrical Single Tweeter (Open Back) | 3000–7000 Hz | |
| (E) | Tweeter Pointing Inward | Above 7000 Hz | 4.2,<br>6.2,<br>8.2,<br>10.2 |

With reference specifically to FIGS. 5A, 5B, 5C, 5D, 5E, 5F, 5G, 5H and 5J, each pictorial representation is of a driver or drivers of a left loudspeaker system. The driver or drivers of a corresponding right loudspeaker system would be a mirror image of the pictorial representation of FIGS. 5, 5A, 5B, 5C, 5D, 5E, 5F, 5G, 5H and 5J. The two woofers in space quadrature shown in FIG. 3, or the single angled woofer of FIG. 4, provided the desired lobe angled inward over the frequency range from about 200 Hz to about 100 Hz. The single woofer, such as shown in FIGS. 1 and 2, asymmetrically positioned, provides the inwardly directed lobe over the frequency range of about 600 Hz to 1000 Hz. The two angled tweeters energized in phase opposition coact with the woofer that they front in phase opposition with the outside tweeter for providing the inwardly directed lobe over the frequency range from about 1000 Hz to 3000 Hz for the embodiments shown in FIGS. 1 and 3. The inwardly pointing asymmetrically located tweeter of FIGS. 2 and 4 coact with the woofer thereof to provide the inwardly directed lobe over the frequency range from about 1000 to about 3000 Hz. The pair of angled tweeters energized in phase opposition shown in FIGS. 1 and 3 coact to provide the inwardly directed lobe over the frequency range from about 3000 Hz to about 7000 Hz. The single inwardly pointing tweeter shown in FIGS. 2 and 4 provides the inwardly directed lobe over the frequency range from about 3000 Hz to about 7000 Hz. Finally, the single tweeter of FIGS. 2 and 4 and the inside tweeter of the systems of FIGS. 1 and 3 provide the desired inwardly directed lobe in the frequency range above 7000 Hz.

Figure 6:
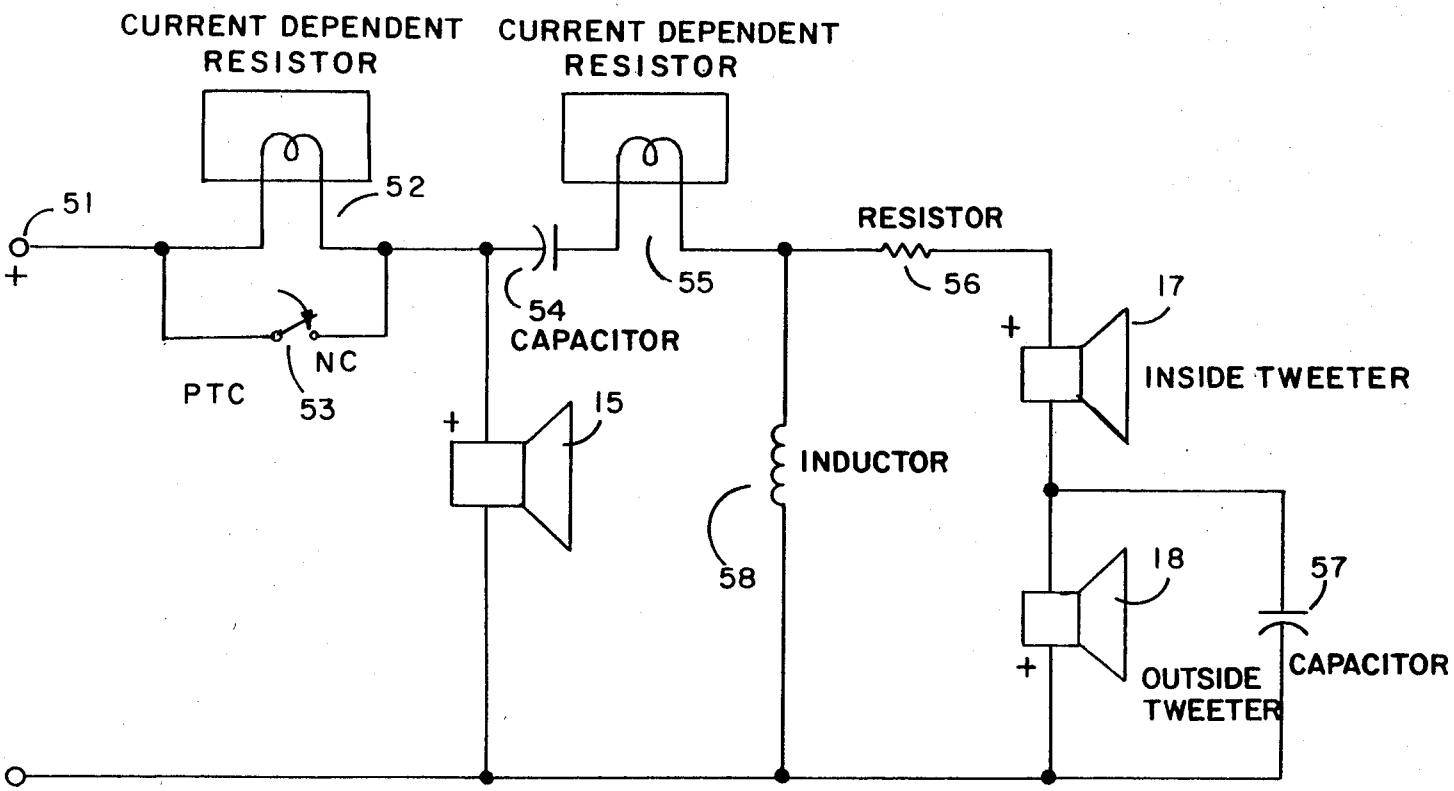
FIG. 6 is a schematic circuit diagram of a loudspeaker system of FIG. 1.

Referring to FIG. 6, there is shown a schematic circuit diagram of a specific system according to the invention having a pair of tweeters and a single woofer as shown in FIG. 1. Signal input terminal 51 is connected to the + terminal of woofer 15 by a current dependent resistor 52 shunted by a normally closed thermal cutout 53 that opens in the presence of heavy current and places current dependent variable resistor 52 in series with the system for protection. The positive terminal of woofer 15 is coupled to the positive terminal of inside tweeter 17 through capacitor 54, current dependent resistor 55 and resistor 56. Inside tweeter 17 is connected in series with outside tweeter 18 in phase opposition as shown. Capacitor 57 shunts outside tweeter 18 to allow inside tweeter 17 to provide the radiation in the frequency range above 7000 Hz. The series combination of resistor 56 and tweeters 17 and 18 is shunted by medium Q inductor 58. The circuitry is similar for the systems of FIGS. 2, 3 and 4.

There has been described novel apparatus and techniques for providing improved spatial perception over a wide listening area with direct radiating speakers with apparatus that is relatively free from complexity and relatively easy and inexpensive to fabricate. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A stereo loudspeaker system for providing good stereo imaging over a wide range of listening positions in a room with the transducing structure itself and passive crossover network means free of complex electronics comprising, left and right direct-radiating loudspeaker systems each in a respective cabinet having a normally vertical axis of symmetry, each direct-radiating system having left and right woofer means for radiating acoustical energy having spectral components in the bass and lower treble frequency ranges and left and right tweeter means for radiating acoustical energy having spectral components above said bass frequency range, respectively, means for mounting each of said woofer means to provide a maximum of radiation within a first predetermined frequency range including lower treble frequencies having a component directed toward the other woofer means along a crossfire direction, means for mounting each of said tweeter means with its axis oriented at an angle coacting with the associated woofer means to provide a maximum of radiation along said crossfire direction within a second predetermined frequency range different from said first predetermined frequency range but including said lower treble frequencies having a component directed toward the other tweeter means, means for mounting said left and right tweeter means adjacent to said left and right woofer means respectively, left and right passive crossover network means for intercoupling said left woofer means with said left tweeter means and said right woofer means with said right tweeter means respectively, each of said crossover network means including means for establishing the relative phase between signals radiated by the associated tweeter means and signals radiated by the associated woofer means at said lower treble frequencies to establish a maximum of radiation at said lower treble frequencies skewed in a direction toward the other of said woofer means and said tweeter means along said crossfire direction, said tweeter means and said woofer means being asymmetrically disposed about the cabinet vertical axis of symmetry.

2. A stereo loudspeaker system in accordance with claim 1 wherein said first predetermined frequency range is between substantially 250 Hz and substantially 1000 Hz and said second predetermined frequency range is between substantially 100 Hz and substantially 3000 Hz.

3. A stereo loudspeaker system in accordance with claim 1 wherein each of said woofer means comprise first and second cophasally energized loudspeaker drivers in space quadrature about a vertical axis.

4. A stereo loudspeaker system in accordance with claim 1 wherein each of said woofer means comprises a loudspeaker driver asymmetrically mounted on the edge of a front baffle.

5. A stereo loudspeaker in accordance with claim 1 wherein each of said woofer means comprises a loudspeaker driver mounted in a baffle angled toward the other woofer means.

6. A stereo loudspeaker system in accordance with claim 1 wherein each of said tweeter means comprises a loudspeaker driver mounted in front of and asymmetrically positioned near the outside edge of the associated woofer means, and means for cophasally energizing the latter driver means and the associated woofer means.

7. A stereo loudspeaker system in accordance with claim 1 wherein said tweeter means comprise means for establishing a maximum of radiation within a third predetermined frequency range at higher treble frequencies above said second predetermined frequency range both in a direction toward the other of said woofer means and said tweeter means.

8. A stereo loudspeaker system in accordance with claim 7 wherein said tweeter means comprises first and second angled loudspeaker drivers, and means for energizing said first and second loudspeaker drivers in phase opposition.

9. A stereo loudspeaker system in accordance with claim 7 wherein each of said tweeter means comprises a single loudspeaker driver open at the back for radiating energy within said third predetermined frequency range both rearward and forward and having its axis at an angle with the axis of the associated woofer means.

10. A stereo loudspeaker system in accordance with claim 1 wherein each of said tweeter means comprises means for establishing a maximum of radiation within a fourth predetermined frequency range at the higher treble frequencies above said first and second predetermined frequency ranges skewed in a direction toward the other of said woofer means and said tweeter means.

* * * * *